US008881865B2

(12) United States Patent
Pierce et al.

(10) Patent No.: US 8,881,865 B2
(45) Date of Patent: Nov. 11, 2014

(54) SINGLE PERSON PORTABLE BELAY ANCHOR SYSTEM AND METHOD

(75) Inventors: Michael Todd Pierce, Chunchula, AL (US); Charles E. Jones, Mobile, AL (US); Keith Barnette, Baxter, TN (US)

(73) Assignee: Pilot Catastrophe Services, Inc., Mobile, AL (US)

( * ) Notice: Subject to any disclaimer, the term of this patent is extended or adjusted under 35 U.S.C. 154(b) by 134 days.

(21) Appl. No.: 13/467,818

(22) Filed: May 9, 2012

(65) Prior Publication Data

US 2013/0299279 A1 Nov. 14, 2013

(51) Int. Cl.
*E04G 1/36* (2006.01)

(52) U.S. Cl.
USPC ..... 182/45; 182/3

(58) Field of Classification Search
USPC ..... 182/3, 8, 45, 48, 49; 248/154, 910, 505, 248/507, 364
See application file for complete search history.

(56) References Cited

U.S. PATENT DOCUMENTS 5,220,740 A * 6/1993 Brault ..... 40/606.02
5,358,068 A * 10/1994 Whitmer ..... 182/113
5,730,246 A * 3/1998 Beard ..... 182/45
5,875,867 A * 3/1999 Beard ..... 182/45
5,979,844 A * 11/1999 Hopkins ..... 248/158
6,112,853 A * 9/2000 Beard ..... 182/45
6,688,427 B2 * 2/2004 Cole ..... 182/113
6,695,095 B1 * 2/2004 Franke ..... 182/3
6,981,680 B1 * 1/2006 Gordon et al. ..... 248/346.01
7,240,770 B2 * 7/2007 Mullins et al. ..... 182/3
8,100,228 B2 * 1/2012 Hamilton et al. ..... 182/142
8,573,609 B1 * 11/2013 Moser et al. ..... 280/47.27
2003/0230692 A1 * 12/2003 Davis et al. ..... 248/346.2
2004/0063553 A1 * 4/2004 Viscount ..... 482/107
2005/0169735 A1 * 8/2005 Pelsue ..... 414/469
2006/0289233 A1 * 12/2006 Flaherty ..... 182/45
2007/0175698 A1 * 8/2007 Ketring ..... 182/8
2010/0126801 A1 * 5/2010 Begin et al. ..... 182/3
2012/0037451 A1 * 2/2012 Payne et al. ..... 182/112
2012/0073900 A1 * 3/2012 Cruz ..... 182/3

* cited by examiner

*Primary Examiner* — Katherine Mitchell
*Assistant Examiner* — Kristine Florio
(74) *Attorney, Agent, or Firm* — Seed IP Law Group PLLC

(57) ABSTRACT

A portable belay anchor system is disclosed that provides a coupling location for safety rope attached to a climber, such as a roof inspector. The portable belay anchor system includes a base having a mast coupled thereto. The mast has a shaft portion and a flange portion. A plurality of removable weights are positioned on the shaft, coupled to the flange portion. The flange portion supports the weights so that the weight is carried by the shaft itself. A retaining member is coupled to the mast to hold the weights on the mast. A shackle is also coupled to the mast. A rope is coupled to the shackle to act a the belay rope which the user positions through a belay brake device.

8 Claims, 6 Drawing Sheets

SINGLE PERSON PORTABLE BELAY ANCHOR SYSTEM AND METHOD

BACKGROUND

1. Technical Field

This invention is in the field of belay anchors and in particular, a portable belay anchor usable by a single man on the roof of a house or other locations.

2. Description of the Related Art

From time to time, insurance adjustors, roof repairmen, and others have a need to climb on a roof in order to assess the damage, perform repairs, or other activities. Ensuring the safety of the person climbing on the roof is of the utmost importance, since a fall from a roof is likely to cause great harm.

Currently, if a roof adjuster is climbing on a steep or slick roof it is common to tie a rope to a large stationary object, such as a tree, and then couple the rope to a safety harness around the waist of the person on the roof to provide a belay. The rope is often run through a belay gear, such as a Gri-gri self-braking belay device of the type made by Petzl. If a large fixed object, such as a tree, is not easily available adjacent to the house, the person climbing the roof may use another person of about their own weight as the belay anchor to hold the rope solidly on the ground as they climb on the roof. Unfortunately, a second person is not always available to act as the belay if a natural anchor is not present. In addition, having two people at a house appraisal increases the cost. Accordingly, it is desirable to have a safe belay system which a single person can use and be assured of their safety.

In other situations, a belay anchor is also needed, such as rock climbing, rescue from a building, climbing a tree, a COPE course, and other uses.

BRIEF SUMMARY

A portable belay anchor system is disclosed that provides a coupling location for safety rope attached to a climber, such as a roof inspector.

The portable belay anchor system includes a base having a mast coupled thereto. The mast has a shaft portion and a flange portion. A plurality of removable weights are positioned on the shaft, coupled to the flange portion. The flange portion supports the weights so that the weight is carried by the shaft itself. A retaining member is coupled to the mast to hold the weights on the mast. A shackle is also coupled to the mast. A rope is coupled to the shackle to act a the belay rope which the user positions through a belay brake device. A user wears a standard climbers belt of a type well known. The belay brake device is coupled to the belt by an acceptable fastener, such as a carabineer. The belay brake device is coupled to the carabineer, having the rope run therethrough. In the event the user falls while climbing, the rope is griped by the belay brake device and keeps the user from falling. One benefit of the portable belay anchor system is that a single user is able to climb a dangerous place, such as a steep roof, without another person present to act as the belay anchor. A further advantage is that the portable belay anchor device may be positioned in any location relative to the structure to be climbed in order to provide the most safety for the climber as well as the greatest access to the structure to be climbed.

A further feature is that the shackle is coupled to the mast with a pivotal coupling. This permits the rope coupled to the shackle to be pivoted to any desired location based on the pivoting of the shackle connection to the mast rather than the pivoting of the rope through the shackle. This increases the ease at which a pivot rotates and also reduces the friction load on the rope that extends through the shackle and through the belay brake device of the user.

DETAILED DESCRIPTION

Figure 1:
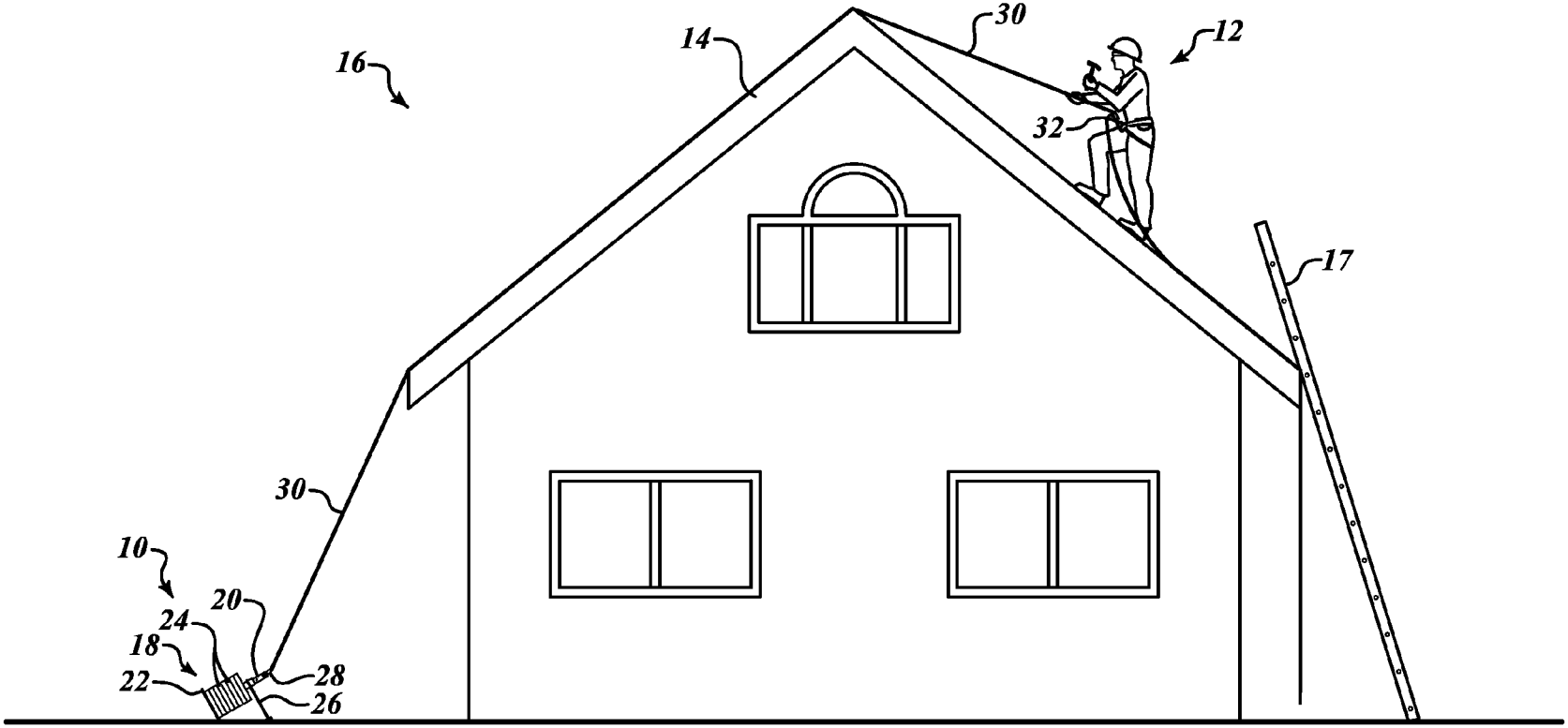
FIG. 1 is a side view of a portable belay anchor system in use with the user on the roof.

FIG. 1 shows an example of a fully portable belay anchor system 10 on a roof 14 of a house 16 while in use. The portable belay anchor system includes a stand 18 composed of a mast 20 and a base 22. A plurality of weights 24 are coupled to the mast 20 and a bipod 26 supports the stand 18 in a stable position. A shackle 28 is coupled to the mast 20 and a rope 30 extends through the shackle 28 and onto the roof 14. The user 12 has a belay device 32 coupled to a harness around their waist and the rope 30 runs through the belay device 32. The belay device 32 can be any of acceptable belay braking devices, many of which are on the market. A preferred belay device 32 is the Gri-gri belay braking device made by Petzl, which is commercially available at any climbing supply store. The user places the rope 30 through the belay device 32, and climbs the ladder 17 to get on the roof as he pulls the rope 30 to keep it taut as it runs through the belay brake device 37. In the event the user loses their balance and puts a load on the rope 30, the belay braking device 32 will automatically lock up to support the user 12 and keep them from falling.

The portable belay anchor system 10 has a number of advantages that provide simple and safe use by a single user 12 in many environments which would be considered too dangerous to attempt without the use of the portable belay anchor system 10. The specific details of the portable belay anchor system 10 and its use will now be described.

Figure 2:
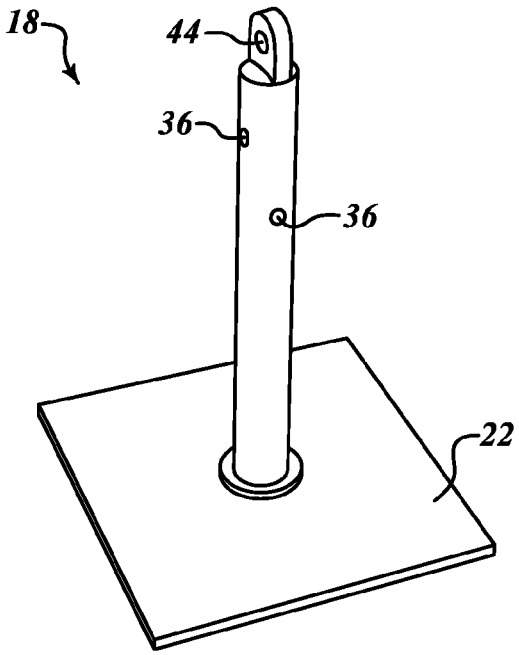
FIG. 2 is an isometric view of a mast and base of the portable belay anchor system.

FIG. 2 shows the mast 20 coupled to the base 22 prior to preparing it to be an anchor. The mast 20 has one or more apertures 36 at different heights for coupling other items to the mast 20 as explained later herein. The apertures 36 can be set at 90° to each other as shown or, in one preferred embodiment, they are parallel to each other. Another aperture 44 is provided in the top for a shackle, explained later herein.

Figure 3:
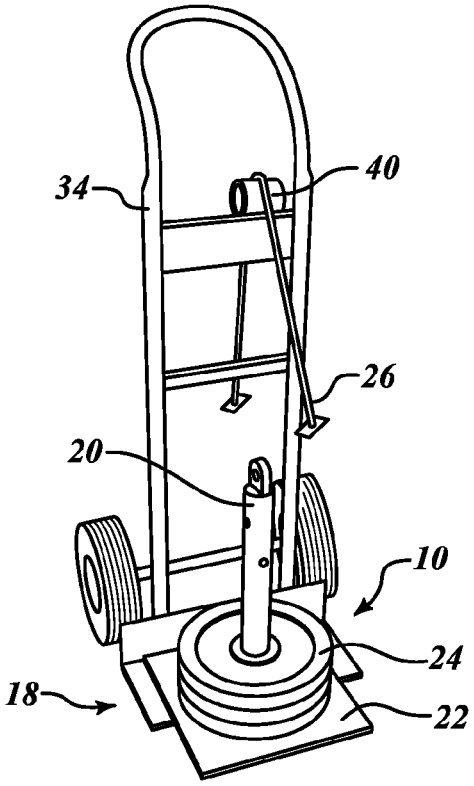
FIG. 3 is an isometric view of the belay anchor system on a transport cart.

FIG. 3 shows an isometric view of a partially assembled portable anchor belay system 10 while it is portable and is being transported in a hand truck 34. Specifically, the support stand 18 is placed on the hand truck 34 and one or more weights 24 are placed on the mast 20. The mast 20 has been previously coupled to a base 22 so that it is rigidly attached to be held in a firm position during use. The hand truck 34 is then used to transport the portable belay anchoring system 10 to a desired location, usually adjacent a house or the structure to be climbed. A bungee cord may be used to secure the load to the handcart while it is being transported. The bipod 26 having a round collar 40 may rest on one or more rails of the hand truck 34, as shown.

Figure 4:
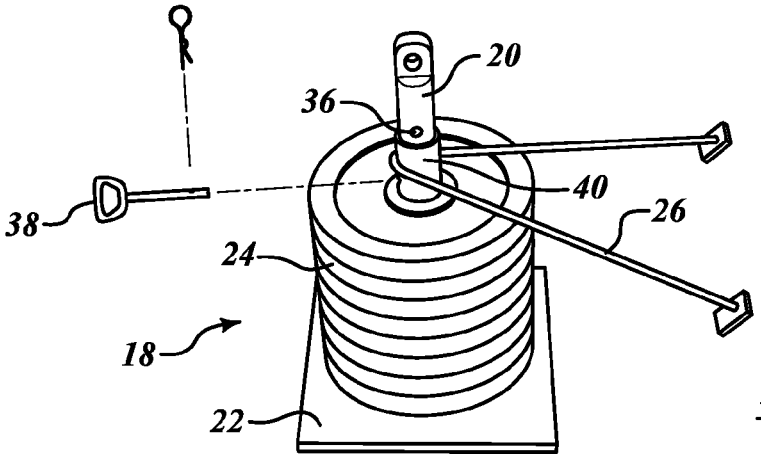
FIG. 4 is an isometric view of the belay anchor system while it is being assembled.

FIG. 4 shows the stand 18 in a vertical position, during assembly, in preparation for use. The base 22 has been placed at a desired location, and additional weights 24 have been placed thereon sufficient to safely support the weight of the intended user. Generally, each weight 24 will be about 25 pounds, though weights of 50 pounds or 10 pounds can be used. Preferably, eight weights of 25 pounds each are used. This will be more than sufficient for a user in the 150-220 pounds range. If more weight is desired, eight weights of 35 to 50 pounds each can be used or eight weights of 25 pounds. Preferably, the weights are transported one or two at a time and placed on the mast 20 after the stand 18 has been set at the selected location. This avoids the user having to transport the 200 pounds of weight at one time. After the weights 24 are stacked on the mast 20, a bipod 26 is then coupled to the mast. The bipod 26 is coupled on top of the weights 24 to prevent them from slipping or moving after they have been installed on the mast 20. The mast 20 includes one or more apertures 36 positioned to be aligned with an aperture in the bipod 26 for reliably coupling the bipod 26 to the mast 20 and also firmly holding the weights 24 in position. Preferably, two or more holes 36 are provided so the bipod 26 can be pressed down into abutting contact with the stack of weights depending on the number of weights used and their combined height. The collar 40 of the bipod is placed on mast 20 and an aperture in the collar 40 is aligned with an aperture 36 of the mast. A tractor pin 38 is placed through the appropriate aperture 36 to snugly hold the weights 24 in place.

Figure 5:
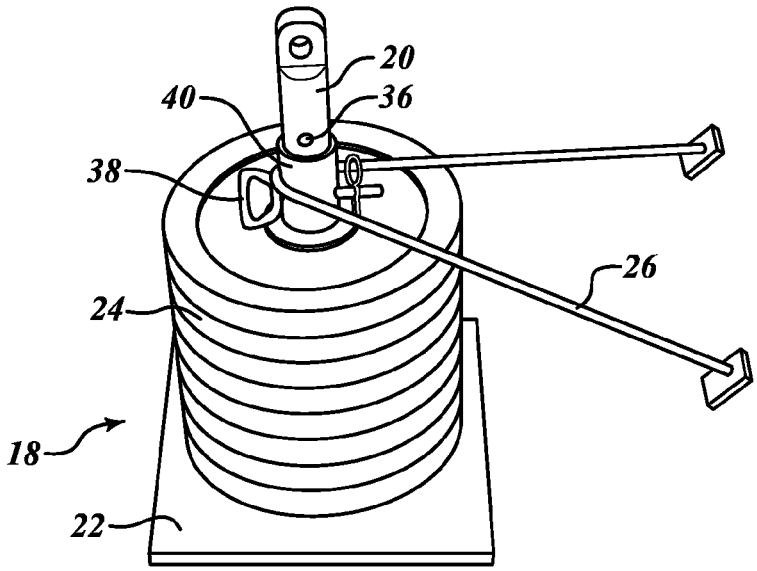
FIG. 5 is a close-up view of the portable belay anchor system with a bipod attached.

FIG. 5 is a completed view of FIG. 4 showing the bipod 26 positioned around the mast 20 and a tractor pin 38 extending through one of the apertures 36. Generally, a plurality of apertures 36 will be provided in the mast 20 so that the bipod support 26 can be coupled at the appropriate location to be pressed into a restraining position for the weights 24 to be assured of holding the weights firmly in position while having multiple locations so that more or fewer weights can be used. As shown in FIG. 5, with the bipod 26 in place, the tractor pin 38 extends through a collar of the bipod leg 26 and performs the dual function of holding the bipod 26 in place and also ensuring that the weights 24 are solidly connected to the mast 20.

Figure 6:
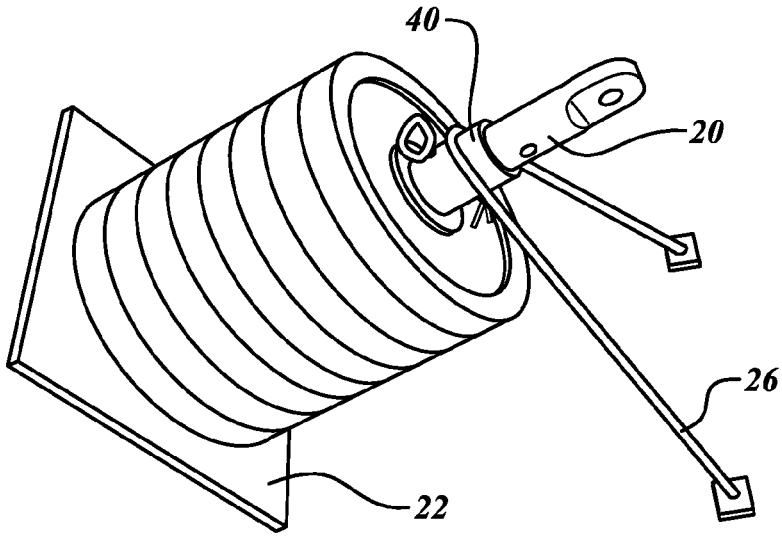
FIG. 6 is an isometric view of the portable belay anchor system with the bipod contacting the earth to support the assembly.

FIG. 6 shows the assembly of the portable belay anchor system 10 in the next stage in which the entire apparatus is tipped on the side with a leg 26 in contact with the earth in a tripod form, with bipod 26 providing two legs and the base 22 being the third leg. In particular, there are two arms 26 which extend at an angle with respect to each other, for example, with an angle of between 20 degrees and 60 degrees, with 30 degrees being preferred. While the bipod 26 has two support arms coupled to a round collar 40 that fits around the mast 20, other arrangements could be made, for example, the support leg 26 could be a single leg which clips to the mast 20 by some other technique, a tripod, or it may have at one end therein that is the tractor pin 38 itself, rather than the collar 40 or be coupled by any other acceptable technique to the mast 20 and have any number of legs.

Figure 7:
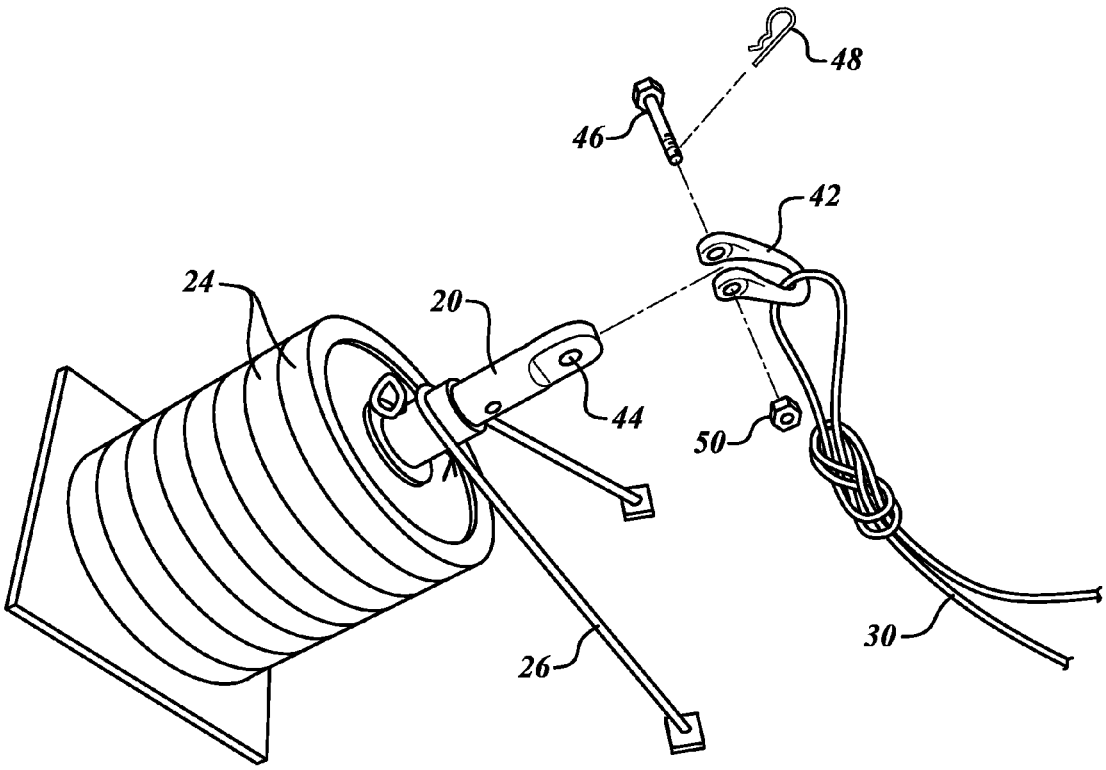
FIG. 7 shows an exploded view of a rope being attached as part of the portable belay anchor system.

FIG. 7 shows an exploded view of a shackle 42 being prepared for attachment to the top of the mast 20. In particular, the belay rope 30 has the appropriate knot tied therein, such as a figure eight or double figure eight knot, a follow-through eight knot, or any of the acceptable knots known in climbing, and then is placed through the mouth of shackle 42. After the rope 30 is in position on the shackle 42, the shackle is coupled to an aperture 44 at the top of the mast 20. A bolt 46 and nut 50 combination is then placed through the common aperture of the shackle and the mast in order to firmly affix the shackle 42 to the mast 20. Any acceptable coupling technique, such as a tractor pin with a cotter pin, or other appropriate fastener, can be used of the type that will safely secure the shackle 42 to the mast 20 in a pivotal connection.

Figure 8:
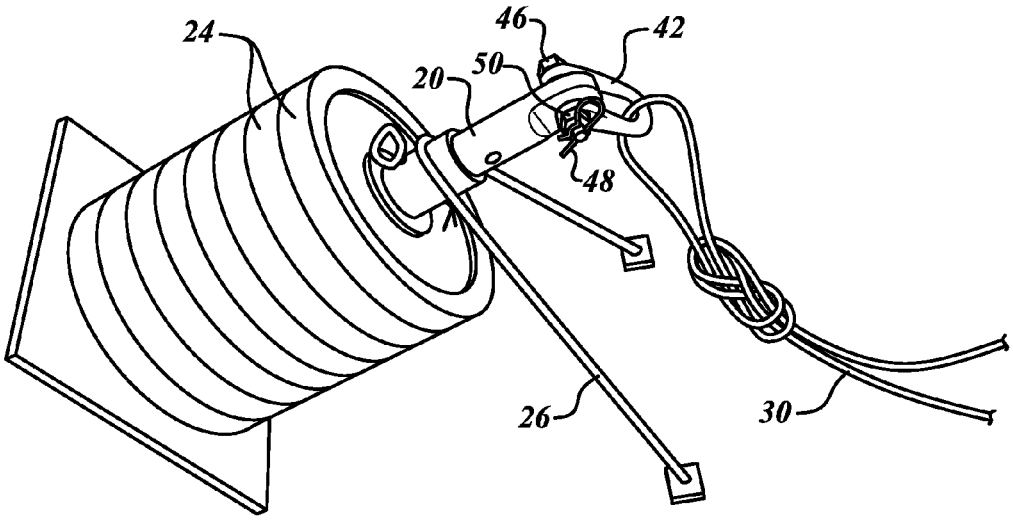
FIG. 8 shows the rope fully attached to the belay anchor system, ready for use.

FIG. 8 shows the fully assembled portable belay anchor system 10 having a rope 30 coupled thereto. The shackle 42 is loosely coupled with a pivot connection and is shown slightly extended for ease in viewing; in practice it will hang straight down due to the force of gravity and the loose pivotal connection.

Figure 9:
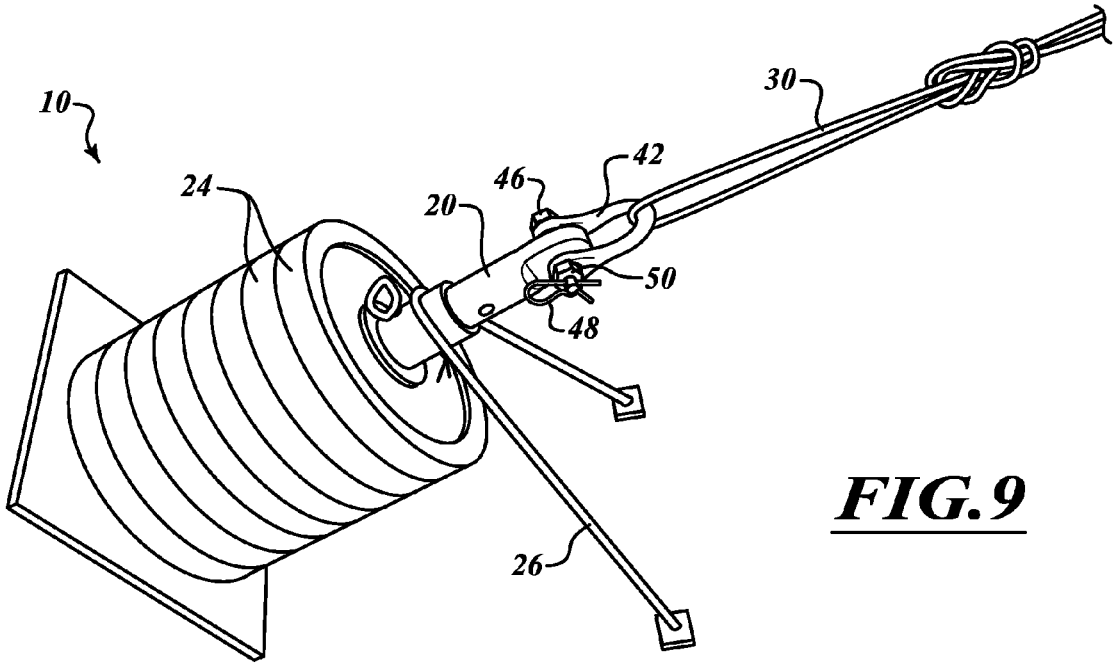
FIG. 9 is an isometric view of the portable belay anchor system being tested before use.

FIG. 9 shows a load placed on the rope 30 which exerts a force on the shackle 42, pulling it away from the mast 20. As can be seen in FIGS. 7 and 8, a bolt 46 and nut 50 combination securely holds the shackle 42 to the mast 20 and a safety cotter pin 48 has been placed through the bolt 46 to ensure that it does not accidently come loose. The bipod legs 26 support the portable belay anchor 10 in the appropriate position, ready for use.

The coupling of the shackle 42 to the mast 20 is a pivotal coupling which permits the shackle 42 to rotate to any position about mast 20. For example, as can be seen in FIG. 8, the shackle 42 has rotated downward under the force of gravity, but is not shown hanging loosely for ease of seeing the connection. The bolt 46 and nut 50 assembly holds the shackle 42 in a secure, yet pivotal connection so that the shackle 42 can easily rotate to any desired angle. Thus, when the user is on the roof, the shackle 42 will rotate to a much more vertical position, and, if the portable belay system 10 is adjacent the house, may be nearly vertical. Having the shackle 42 coupled with the rotatable system reduces the wear on the rope 30 and also greatly reduces the stress points that may be experienced if the rope itself must be the pivoting mechanism which rotates through an eyelet or an anchor. If the rope 30 rotates back and forth rather than the shackle 42, the repeated rubbing of the rope 30 will wear on the rope and it may prematurely break or fray. In addition, if the rope 30 is required to rotate through the shackle 42 or some other connection, it may catch at one location and then when weight is placed thereon suddenly give way, rapidly changing the length of the rope. The extra stress which may occur because of a sudden slippage of the rope 30 in the shackle 42 may cause some other portion of the rope to break, which has become weak through fraying, or it may cause the user to slip so that his face hits onto the climbing surface, such as a roof, or, in even more dangerous situations in which sudden, unexpected force is put on the rope 30 may cause the entire portable belay anchor system to move slightly or lift off the ground for a moment, thus possibly resulting in injury to the user. Accordingly, having the shackle 42 coupled to the mast 20 through a metal bolt 46 that is fully pivotable and can be rotated to any desired location provides additional safety features and ensures long-term use of the rope 30 with reduced damage due to being coupled to the shackle 42 while in use.

The portable belay anchor system 10 is therefore a static system that provides static weight, while at the same time providing a dynamic coupling system which permits dynamic movement of the angle at which the rope 30 can attach to the mast 20 at a dynamic angle achievable with the pivoting of mast 42. The use of the shackle 42 coupled about the pin 46 in a rotatable arrangement is also more advantageous than a carabineer or other fixtures which might be attached to the mast 20 because changing the angle at which a carabineer or other coupling device attaches to the mast 20 may also cause rubbing or rocking of the carabineer or other attachment device, thus increasing the wear and tear on the connection at one of its more critical locations, and increasing the danger to the user.

When the bolt 46 is placed through the aperture 44 of the mast 26 and also to the shackle 42, the nut 50 is placed on the shackle and threaded onto the bolt until it contacts and abuts against the shackle 42. After being secured finger-tight, the nut 50 is backed off at least a quarter turn, and preferably a half turn or more, so that it is not in abutting or in frictional contact with the shackle 42. The cotter pin 48 is then placed through the aperture in the end of the bolt 46, thus securely holding the nut 50 in position so that even if it accidently rotates, it will abut against the cotter pin 48 and cannot rotate further, and cannot come off of the safety pin which is composed of the bolt 46. Backing the nut 50 a quarter to a half turn off of the shackle 42 after it has contacted it ensures that the shackle 42 is coupled with rotatably loose connection to the bolt 46. It also ensures that the bolt 46 can easily rotate within the aperture 44 of the mast 20. Thus, the mouth of shackle 42 is not compressed, and two independent points of rotation are assured of being present.

The shackle 42 is conveniently coupled to be able to independently pivot about two different bearing locations. Specifically, the bolt 46 which extends through the eyelet 44 can rotate about the eyelet 44. In addition, or alternatively, the shackle 42 having the pin 46 extend therethrough can rotate about the pin 46. Thus, two different locations that independently permit full and complete rotation of the shackle 42 are provided to ensure that it is always easily rotated with respect to the mast 20. Appropriate lubrication can be added at either the eyelet 44, where the bolt 46 passes through the mast 20 to provide low friction on that bearing surface or to the shackle 42, or both, to ensure ease of rotation and long life of both bearing surfaces, since it often rotates under heavy weight while the user travels on the roof to different locations. Providing two independent rotation pivot choices, either of which alone is sufficient, ensures that one is always available, in the event one of them becomes stuck or hardened.

Preferably, the nut 50 is not threaded so tightly onto the bolt 46 that the shackle 42 is bound hard against the mast, making it difficult for it to rotate. Rather, the nut 50 is threaded onto the bolt 46 sufficient to solidly retain the shackle 42 in position, and then a cotter pin 48 is placed through an aperture at the end of the bolt 46 after the nut 50 is securely fastened in order to hold it in position and ensure that it cannot become loose, even if it is not fully tightened down against the shackle 42. Accordingly, lock washers or other locking apparatus to hold the nut 50 on the shackle 42 is not needed, since the cotter pin 48 holds the bolt 46 in a position to ensure that it cannot be removed, while permitting sufficient slack for ease of rotation of the shackle 42.

After the portable belay anchor 10 has been fully assembled, it is ready to be tested before use. Preferably, the person using the belay anchor 10 couples the rope 30 around their waist and puts a large amount of weight, preferably leaning with all their weight, on the system to ensure that it is properly coupled and will support their weight. A safety check is done of all the connections, namely the mast 20 to the base 22, the weights 24 to the mast 20, the shackle 42 to the mast 20, the rope 30 to the shackle 42, and the rope 30 to the user 12 to ensure that all parts of the system are properly connected, and ensure the full and complete safety of the user while climbing the roof.

With the portable belay anchor system 10 now fully assembled, tested, and ensured of being safe, the user 12 is now ready to ascend the roof. The rope 30 will be connected to a heavy rubber ball, such as a lacrosse ball, a softball, or other appropriate weight. The throwing weight can be attached to the rope 30 by any acceptable technique, such as duct tape. The end of the rope 30 could be tied to the roll of duct tape for use of the duct tape as the weight. However, for ease in throwing and to be assured of having a sufficient weight that can be easily thrown that is not so heavy as to cause damage, a softball is preferred. The ball and line are thrown over the roof and land on the other side. The user then goes to the other side and pulls the rope tight so that the rope is taut across the top of the roof as shown in FIG. 1. The user places on a climbing harness of a type normally used by climbers. Many such safety climbing harnesses are available and are commercially sold by numerous companies, including Petzl, Black Diamond, REI, and others. The climbing harness preferably has a number of loops to which carabineers may easily be attached. An approved climbing carabineer is attached to the climbing harness that a person is wearing. A belay braking device, such as the Gri-gri device sold by Petzl, is then coupled to the rope 30 and the belay device is then coupled to the carabineer. The proper and safe coupling of a rope 30 to a belay brake device and the belay brake device to a carabineer and to the harness of the user, should be done according to standard safe climbing techniques, such techniques being well known in the art and therefore need not be described in more detail herein. The user 12 then climbs onto the roof, preferably using a ladder 17, as shown in FIG. 1. The user 12 feeds the rope through the belay braking device 32 as he climbs the ladder to always keep the rope 30 at the appropriate length so that it can function to avoid him impacting the ground if he slips.

Figure 10:
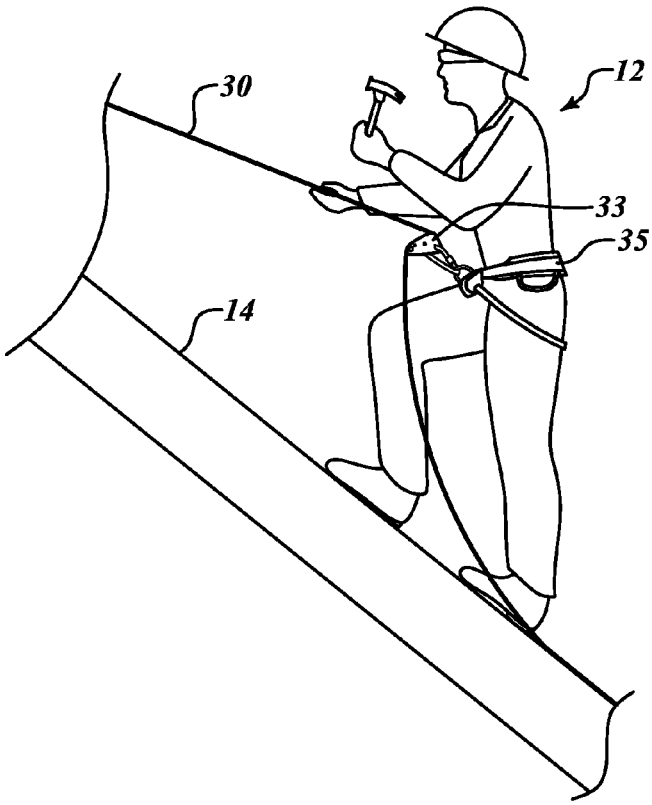
FIG. 10 shows a user on a roof making use of the belay anchor system.

FIG. 10 shows a user 12 while on a roof 14, making use of the portable belay anchor system 10. The rope 30 extends through the belay braking device 32, which is coupled by the carabineer 33 to the safety harness 35 that the user 12 is wearing. The user 12 may then safely and easily climb to numerous locations on the roof in order to check which parts need repair, perform repairs, and take care of other matters as appropriate.

As is known, the rope 30 can be pulled through the belay braking device 32 to take up the slack and be shorter as the user 12 walks up to the peak of the roof and, as the user walks to far ends of the roof at either side, far from the portable belay anchor, the rope 30 can slip backward the other way through the braking device 32 providing an extended length of travel. In the event the user 12 suddenly slips or falls, the braking device 32 is preferably of a type that will automatically grip the rope 30 and safely stop the user 12 from falling. Such automatic belay anchoring devices work similar to a seat belt in a car, that grips solidly and quickly in the event excessive force is placed on the rope 30 traveling through the belay brake 32. Indeed, if the user 12 wishes to clamp the rope, he may simply put a quick jerk on the belay brake 32 and it will lock the rope 30 solidly in place so that he is now safely anchored at a fixed location. The user 12 can then put all his weight on the rope 30 and be assured that it is safely and securely held so that he will not slip.

Many roofs 14 are sufficiently steep that without a belay anchoring system the user could not safely traverse the roof and be assured of not falling off. The belay anchoring system 10 is a portable device which a single user can transport, assemble, and make use off, and be assured of their own safety during the entire time they are on the roof.

In the event the user wishes to work on the other side of the roof, after he has completed all the work necessary for one side he climbs down the ladder 17, disconnects himself from the rope 30, then, using the hand truck 34, carries the portable belay anchoring system 10 to the other side of the house, throws the rope over to the other side of the house, and climbs up on the roof 14 on the other side of the house. Using this technique, all portions of the house can be easily inspected, and the portable belay anchoring system 10 can be easily moved from a first location adjacent the house to a second or third or fourth location adjacent the house, so that all parts of the roof can be fully inspected. Indeed, for some complex homes, the belay anchoring system 10 may be required to be moved three or more times, since some roofs may have unusual angles that need to be inspected.

Preferably, the rope 30 is positioned in such a way that it does not rub against a chimney, a TV antenna, or any other locations on the roof, since if full weight is put on the rope 30 it may break these devices on the roof, which would require additional repair. Also, the rope 30 preferably does not rub against the very top ridge of the house or other objects on the house, to avoid causing damage to either the house roof and the rope. Accordingly, proper care is taken of the rope when moving to avoid splash corners in the gutter, sharp ridge lines, protruding objects from the roof or from the gutter, or a ridge cap on the roof. Thus, it is useful to keep in mind that the rope 30 has a sawing effect on the ridge cap if the user puts his full weight on the rope as they walk around the roof, which can cause damage to both the ridge cap and the rope. The user can place a carpet on the ridge cap so that the rope is in contact with the carpet or some other intermediate device so that the rope is stable on the ridge and does not injure either the rope or the ridge cap. In addition, the user needs to be careful if they move off center on a hip-type roof, that the rope could slip off the main ridge, resulting in a catastrophic accident. Therefore, the user has the benefit of the full advantage of portable anchor system 10 in that they may easily move the belay anchor to different locations around the house to be ensured that they do not have to go on the other side of a hip roof which may cause an unexpected and catastrophic slack in the rope due to a change in the orientation between the user and the anchor. Without a portable anchor, for example, if the rope 30 is tied to a tree or other stationary object, the user may be prohibited from going to certain parts of the roof because doing so may cause the rope to impact other objects on the roof, slip off the main ridge if the user is on the other side of a hip-type structure of a roof, or cause other problems. With the portable belay anchor system 10, the user is able to select a desired location for the belay anchor which is most likely to ensure full and complete access to the roof at desired locations rather than being stuck with having to compromise his safety because of a less than preferred location of a tree or other natural anchor that may be present.

Figure 11:
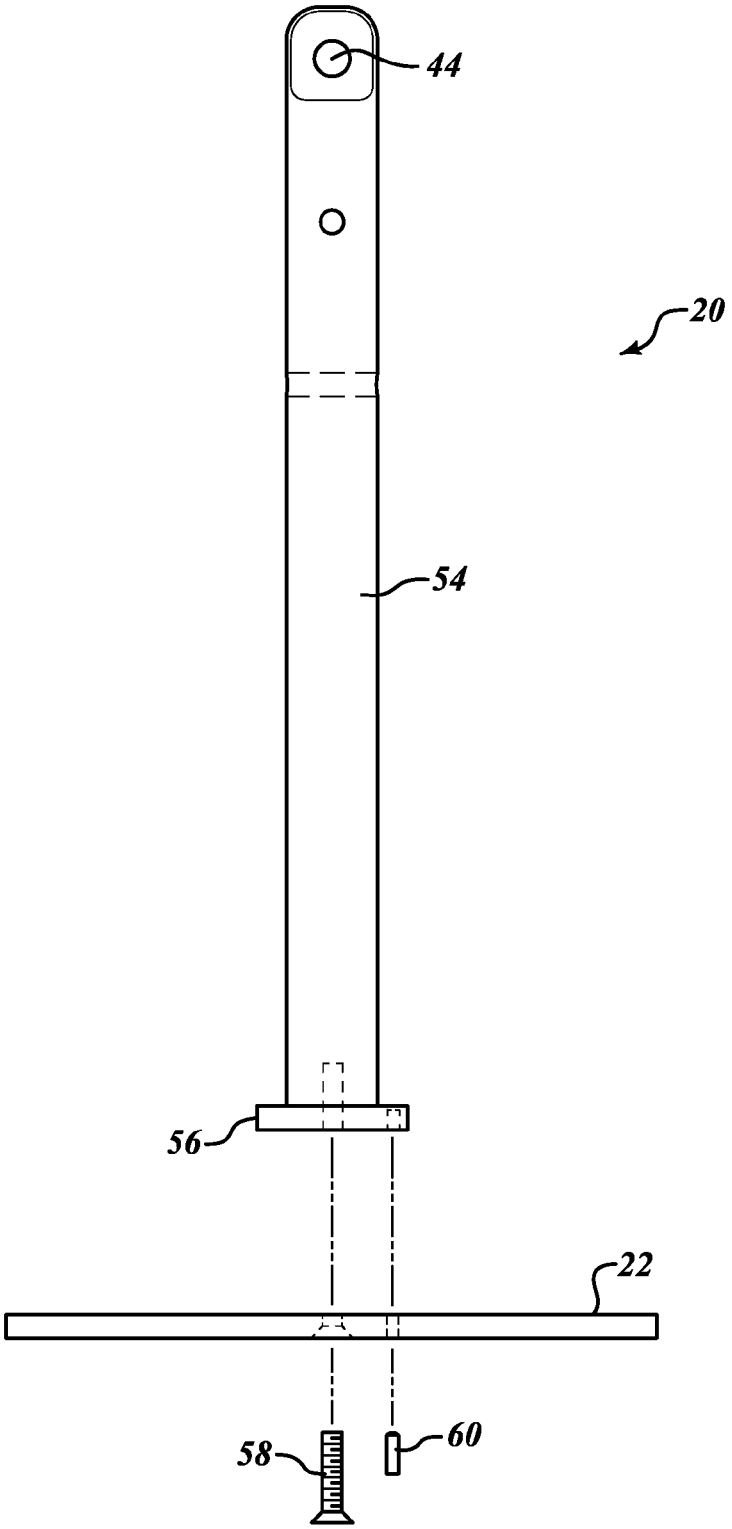
FIG. 11 is a side view of the portable belay anchor mast and support base in an exploded view.

FIG. 11 is a side exploded view of the mast 20 prepared for coupling to the base 22. The mast 20 has a particular construction which ensures its safe holding of a plurality of weights 24 and the holding of the weight of the user 12. In particular, the mast 20 preferably includes a shaft portion 54 and a flange portion 56. The shaft portion 54 has one or more apertures therein for securing the tripod as previously described, as well as an aperture 44 at the top thereof to receive the shackle 42. The flange 56 is an integral, contiguous piece of the shaft 54 in one embodiment. Preferably, the mast 20 is milled from a single piece so that the diameter of the shaft 54 is reduced from an initial starting diameter of the flange 56. The flange 56 is therefore part of the single contiguous shaft 54. The mast 20 is coupled to the base 22 with a beveled bolt 58 and with a stabilizing pin 60. The bolt 58 extends into a threaded hole in the bottom of the mast 20 and the pin 56 extends through an aperture in the flange 56. Preferably, the bolt 58 is threaded tightly into the mast 20 and a locking fluid or locking nuts can be used to solidly hold it in position. The pin 60 can be coupled with a friction fit to the base plate 22 and the flange 56 through pressing, hammering, or other technique. Alternatively, the pin 60 may have a cotter pin or some other coupling device at either end thereof in order to solidly affix it to both the base plate 22 and the flange 56. Preferably, the pin 60 is mounted with the bottom flush with the bottom of the base plate 22. The use of two coupling points, the bolt 58 and the pin 60, ensures that the mast 20 is always in a fixed condition relative to the base plate 22, and does not rotate either direction. The pin 60 can be a threaded screw, similar to bolt 58, if desired. Two or more pins 60 can be used if a more secure coupling is desired, though, in most designs, the use of a single screw 58 and one pin 60 is preferred.

The use of a flange 56 at the bottom of the mast 20 has particular advantages. The individual weights 24 abut against the flange 56. They do not contact the base plate 22 and, in fact are held spaced apart from the plate by a distance equal to the thickness of flange 56. This cannot be seen in some of the other prior FIGS. 3-9 because of the view angle, because with the weights present, the flange 56 cannot be seen. The flange 56 therefore supports the full weight of the various weights 24, and the mast 20 is the core anchoring component of the anchor system. The base plate 22 which is coupled by bolt 58 functions as part of the tripod stand, but the weight of the user 12 through the rope 30 is not on the bolt 58 or on the threads thereto. Accordingly, the bolt 58 and its threads are not placed under repeated stress while the system is in use. Instead, the flange 56 holds the weights and receives the full load based on force which is applied by the user and the weights. This provides an additional measure of safety, because the base plate 22 is not in danger of being ripped off of the mast 20. In the unlikely event that the base plate 22 because loose, the mast 20 still provides the full and proper anchoring support since the base plate 22 is not required for proper function of the anchoring system. Thus, if the bolt 58 were to weaken and strip the threads or become loose and fall out, even if the base plate 22 because disconnected, the anchoring system is not compromised and the additional level of safety provided by the mast 20 with the flange 56 ensures that the user is not in danger and will be fully supported by the rope 30 which is coupled to the mast 20 having the weights solidly affixed thereto.

In one embodiment, the base 22 is not required, and an enlarged flange 56 may be used with the weights stacked thereon. However, this is not preferred because the weights may sit on the ground and become uneven as the mast 20 is tipped at different angles and preferably, to keep the weights clear and the system clean, only the base plate 22 and bipod legs 26 contact the ground. The mast 20 as well as the weights are kept spaced above the ground to maintain safe and clean operation.

Since the flange 56 is an integral part of the shaft 54, the mast 20 can be easily made to support extensive weight, for example in the range of 3000-8000 pounds. If a simple still shaft is made for the mast 20, having a diameter in the range of 2 inches and a flange having a diameter in the range of 3 inches, calculations show that the rated load is in excess of 5000 pounds. Thus, a large amount of weight can be placed thereon, and the mast 20 can be assured of supporting any user under any conditions.

While it is preferred that the flange 56 be an integral single piece of the shaft 54, it is possible that it can be welded or coupled by some other technique to the shaft 54. If the flange 56 is welded to the shaft 54, additional testing will be required to ensure that the weld is solid and that the bond between the shaft 54 and the flange 56 is more than sufficient to hold all the weights, as well as the user, together with the appropriate multiple of a safety factor. Thus, while a weld connection between the flange 56 and 54 may be used, as well as other types of connections, the use of an integral shaft and flange that has been machine milled from a single piece to create the mast 20 is preferred.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A portable belay anchor system, comprising:

a base;

a mast coupled to the base, the mast having a shaft portion and a flange portion coupled to the shaft portion, the flange portion having a first selected diameter;

a plurality of removable weight members each having an aperture that is smaller in diameter than the diameter of the flange, each weight member being coupled to the mast portion by having its aperture over the shaft portion, the plurality of weight members having their weight supported by the flange portion when the weight members are on the mast;

a retaining member coupled to the mast to removably retain the weight members on the mast;

a shackle coupled to the mast with a pivotal coupling; and a rope that is removably coupled to the shackle to provide a coupling of the rope to the mast.

2. The portable belay anchor system of claim 1, further including:

a bipod stand coupled to the mast to support the weight of the mast when the mast is tilted at an angle.

3. The portable belay anchor system of claim 2, further including:

the bipod stand including bipod legs and a cylindrical collar;

said cylindrical collar coupled to the bipod legs;

an aperture through the bipod collar;

the retaining member extending through the aperture of the bipod collar; and an aperture in the mast to removably couple the bipod stand to the mast.

4. The portable belay anchor system of claim 1 wherein the shackle is pivotally coupled to the shaft with a pivot pin and the pivot pin is pivotally coupled to the shaft.

5. The portable belay anchor system of claim 4, further including:

a cotter pin coupled to the shaft and to the pivot pin to ensure the pivot pin is pivotally coupled to the shaft with a secure pivotal connection.

6. The portable belay anchor system of claim 1, further including:

a pivot pin extending through the shackle and through the mast to couple the shackle to the mast with the pivotal coupling having a first pivot bearing surface between the pivot pin and the mast and a second pivot bearing surface between the pivot pin and the shackle.

7. The portable belay anchor system of claim 1 wherein the flange is at the base of the shaft, the flange is of circular shape having a diameter larger than the shaft and positioned to support the mass of the weights.

8. The portable belay anchor system of claim 1, wherein the shaft portion and flange portion are milled from a single piece of metal.

* * * * *